US011000113B2

(12) United States Patent
Salvitti

(10) Patent No.: US 11,000,113 B2
(45) Date of Patent: May 11, 2021

(54) MAGNETIC FIREARM AND KNIFE HOLSTER

(71) Applicant: Alfred W. Salvitti, Glen Riddle, PA (US)

(72) Inventor: Alfred W. Salvitti, Glen Riddle, PA (US)

(73) Assignee: Alfred W. Salvitti, Glen Riddle, PA (US)

( * ) Notice: Subject to any disclaimer, the term of this patent is extended or adjusted under 35 U.S.C. 154(b) by 0 days.

(21) Appl. No.: 16/805,238

(22) Filed: Feb. 28, 2020

(65) Prior Publication Data

US 2020/0196741 A1 Jun. 25, 2020

Related U.S. Application Data

(63) Continuation of application No. 15/530,140, filed on Dec. 5, 2016, now abandoned.

(60) Provisional application No. 62/386,533, filed on Dec. 4, 2015.

(51) Int. Cl.

| | |
|---|---|
| ***F41C 33/02*** | (2006.01) |
| ***F41C 33/04*** | (2006.01) |
| ***A45F 5/00*** | (2006.01) |
| ***A45F 5/02*** | (2006.01) |
| ***B26B 29/02*** | (2006.01) |

(52) U.S. Cl.

CPC ..... *A45F 5/00* (2013.01); *A45F 5/021* (2013.01); *B26B 29/025* (2013.01); *F41C 33/0236* (2013.01); *F41C 33/04* (2013.01)

(58) Field of Classification Search

CPC .. F41C 33/00; F41C 33/02–029; F41C 27/16; A45F 2200/0591; Y10S 224/911; Y10S 206/818; B26B 29/025

See application file for complete search history.

(56) References Cited

U.S. PATENT DOCUMENTS

| | | | |
|---|---|---|---|
| 2,910,804 | A | 11/1959 | White |
| 3,008,617 | A | 11/1961 | Villwock |
| 3,051,130 | A | 8/1962 | Morris |
| 3,978,902 | A | 9/1976 | Adkison |
| 4,690,316 | A | 9/1987 | Peterson |
| 4,942,663 | A | 7/1990 | Ray, Sr. |
| 5,449,103 | A | 9/1995 | Tilley |
| 5,915,610 | A | 6/1999 | Russell |
| 6,049,914 | A | 4/2000 | Heilman |
| 6,427,340 | B1 | 8/2002 | Cohen |
| 6,457,239 | B1 | 10/2002 | McLaughlin |
| 6,457,252 | B1 | 10/2002 | Kershner |

(Continued)

*Primary Examiner* — Brian D Nash

(74) *Attorney, Agent, or Firm* — Michael Best & Friedrich LLP

(57) ABSTRACT

A firearm holster or knife sheath with an imbedded magnetic holstering locator is disclosed. A strong magnet source is positioned at a preferred insertion point of a firearm holster or knife sheath. To facilitate inserting a firearm or edged weapon in a holster or sheath, a magnet located at the insertion edge opening in each instance allows the user to more safely reholster or re-sheath either a firearm or a knife without a need to break focus on a threat. The magnetic insert attracts the leading edge of the firearm or the knife thereby allowing the user to quickly recognize the correct position to begin insertion of the firearm or the knife into the holster or sheath without the need to observe the arm movement in the process.

11 Claims, 2 Drawing Sheets

(56) References Cited

U.S. PATENT DOCUMENTS

| | | | | |
|---|---|---|---|---|
| 6,571,997 | B2 | 6/2003 | Dedrick | |
| 6,641,009 | B2 | 11/2003 | French et al. | |
| 7,086,156 | B2 | 8/2006 | McLaughlin | |
| 7,117,625 | B2 | 10/2006 | Pikielny | |
| 7,422,180 | B2 | 9/2008 | Tang | |
| 8,646,971 | B2 | 2/2014 | Doyle | |
| 8,727,294 | B1 | 5/2014 | Harms | |
| 9,360,275 | B2 | 6/2016 | de Nijs | |
| 9,404,710 | B1 | 8/2016 | Beard et al. | |
| 10,173,334 | B2 | 1/2019 | Woolery | |
| 2002/0116829 | A1 | 8/2002 | McLaughlin | |
| 2002/0175100 | A1 | 11/2002 | Holland et al. | |
| 2003/0197042 | A1 | 10/2003 | Warren | |
| 2004/0231164 | A1 | 11/2004 | McLaughlin | |
| 2005/0082323 | A1 | 4/2005 | O'Hair | |
| 2006/0032876 | A1 | 2/2006 | Goffinet | |
| 2007/0251962 | A1 | 11/2007 | Pikielny | |
| 2008/0272162 | A1 | 11/2008 | Gamble | |
| 2010/0036404 | A1* | 2/2010 | Yi ..... | A61B 17/3213 606/167 |
| 2014/0224847 | A1 | 8/2014 | Miller | |
| 2016/0254083 | A1 | 9/2016 | Bennett | |
| 2016/0318200 | A1 | 11/2016 | Wright | |
| 2016/0377373 | A1 | 12/2016 | Feldstein | |
| 2017/0043493 | A1 | 2/2017 | Seber et al. | |

* cited by examiner

MAGNETIC FIREARM AND KNIFE HOLSTER

CROSS REFERENCE TO RELATED APPLICATIONS

This application is a continuation of U.S. patent application Ser. No. 15/530,140, filed Dec. 5, 2016, which claims priority to U.S. provisional patent application No. 62/386,533 filed on Dec. 4, 2015.

BACKGROUND OF THE INVENTION

Field of the Invention

The invention relates to holsters which are used to carry firearms such as pistols or carry edged weapons such as knives as well as a method of using the holster.

Related Background Art

The use of sheaths and holsters to carry handguns or other weapons on the body of the user is well known. Firearm holsters are typically mounted on a belt but may also be located in other places on the wearer's anatomy, such as an ankle, a chest rig, an undercoat shoulder holster system, or other devices. Such weapon holders are typically also secured with belt clips, straps or bands to attach to the user. Fighting knives and similar edged weapons are also typically carried on a person by using a holster-like device sometimes referred to as a knife sheath. Such holders used for edged weapons are generally similar in theory of operation to a firearm holster which is used to carry a pistol or similar firearm. For the purposes of this disclosure, the terms "sheath" and "holster" may be used sometimes interchangeably. Generally, a holster includes a sheath or pouch-like structure which secures the body of the weapon to the remaining portion of the holster. The holster may further include belt clips or straps which allow the holster to be attached to the user to secure the weapon when the weapon is not drawn or in the hand of the user.

Techniques for fighting using personally carried weapons have been well developed over the years. One maxim of personal defense or military combat training provides that a combatant should not remove his or her eyes from a view of a threat or an incident in which he or she is engaged with a weapon in hand even after any conflict has ended. This provides an issue in re-holstering a firearm or re-sheathing a combat knife because typically a user must glance to the holster or sheath for a moment while trying to insert the firearm or knife into the holding device. Failure to get the weapon secured correctly could cause one to lose time, potentially drop the weapon, or injure oneself when trying to re-sheath a knife, particularly with sharp edges, if missing the knife sheath during the reinsertion process.

What is needed is a manner in which a leading edge of a firearm, typically the muzzle, or the point of an edged weapon can be attracted and guided to the threshold of the opening or pouch structure of the holster or sheath such as to allow the operator to securely and positively identify the correct location to insert the firearm or the knife into the holster carrying device without looking down or away from a threat to view such device. In the past, flared openings at the insertion end or pouch opening of a holster or sheath has been used to allow the re-holstering to occur more smoothly by guiding the insertion effort. But such methods have not been effective and require a larger threshold area making the holster or sheath much larger than it needs to be.

An improvement in both the means of and method of securing a weapon into a holster is needed. A passive device without moving parts or powered systems is needed which will allow a trained individual to locate a holster device and re-holster their firearm or secure their knife in a sheath without looking down at that operation while engaged in the procedure. Such a device or apparatus would also improve fighting techniques and provide a means to be more effective in personal combat.

SUMMARY OF THE INVENTION

The disclosed invention is an improved holster or sheath carrying device for a firearm or knife. The holster or sheath may be attached to a belt, shoulder sling or other carrying device on or off of the user's body. The present invention provides an improvement in the apparatus by embedding a permanent magnet at a location on the holster or sheath that will attract the leading edge of a firearm or a knife when the user brings either device in close proximity to the holster when re-holstering or re-sheathing the respective weapon. The weapon itself must be made of a material subject to attraction to a magnet, such as a ferrous material. A permanent magnet is located in the proximity of the threshold of a given holster or knife sheath. The threshold, sometimes referred to as the mouth of a sheath, is a general point of entry for an edged weapon or a firearm to slide into the holster or sheath. The area on the holster or sheath which secures the weapon is a pouch-like structure into which to insert the weapon.

The preferred initial point of contact of the weapon is the threshold or mouth of the holster or sheath. The magnet attracts the metal in the firearm or the knife providing that the weapon is guided to the preferred initial contact location with little effort by the user other than to transition the leading point of the weapon to the proximity of the holster and in the general location of the magnet. The leading edge of the weapon is the knife point or tip, or the muzzle end of a firearm.

This action allows the user to locate the holster and insert the weapon into the holster or sheath without the requirement of using a second hand to guide the insertion effort or looking at the holster or sheath to insert the weapon back into its fully seated position within the pouch portion of the holster or sheath.

The present invention provides an improvement in combat activity and personal defense training by allowing the weapon to find the preferred initial contact point so as to be holstered or sheathed without the need to locate the holster or sheath by taking the user's eyes off of the incident or threat in which the user may be engaged. It also a need to use the free hand to locate the holster prior to inserting the weapon therein.

In firearms training or self defense training using edged weapons, one of the basic tenants is that a user of a weapon not take their eyes off of a scene or situation even for short periods of time. It is also commonly taught that when a combat threat has been contained or eliminated, a weapon in use should be promptly holstered for safety and to provide both hands of the user to remain free to address any continued threat or the next incident. In quickly holstering a firearm or securing an edged weapon in a sheath, it would be advantageous for the holster to provide an attracting force to the appropriate location on a holster to allow the weapon to contact the holster in the right location. This correct location would be ideal for the leading edge of the firearm to enter the holster or the pointed edge of a knife to enter a sheath without the need to use a second hand to feel for the location or for the user to glance down or over at a location of the holster or sheath. The present invention provides that improvement through the use of a permanent magnet embedded in the holster or sheath material.

It is therefore the object of the present invention to provide a means to automatically attract the leading edge of a weapon when the user of that weapon is attempting to secure, reholster or re-sheath the weapon after drawing the weapon for use. It is also the object of the present invention to provide an improved method of holstering or securing a weapon into a carrying holster about the body of the user without using a power source or other technologically complicated means that would be prone to failure or require recharging or maintenance. It is also is an object of the present invention to provide a means of returning a weapon to a holster on the person of a user of the holster without the need to focus on the placement of a weapon during the movement of the weapon toward the vicinity of the holster.

DETAILED DESCRIPTION OF THE INVENTION

Figure 1:
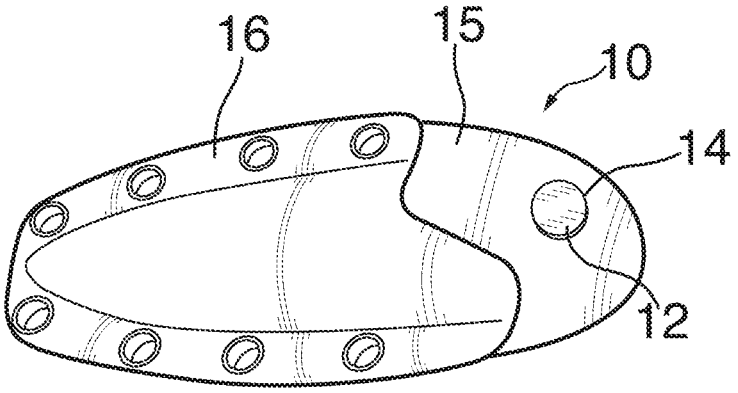
FIG. 1 is a top view of a knife sheath showing a preferred location of an embedded permanent magnet at the mouth of the sheath.

And now the invention will be described with reference to the various Figures as numbered to describe constituent parts of the invention. Like numbers refer to like parts in the drawings.

Turning to FIG. 1, a close up of a knife sheath 10 with a permanent magnet 12 installed in knife sheath entry area 14 is shown. Sheath 10 is comprised of a back piece 15 which mates with front piece 16 such as to create a pouch-like volume between piece 15 and piece 16 to accept knife 20. Magnet 12 is a permanent magnet with sufficient magnetization to provide a useful attracting force to any ferrous metal or other material which would be attracted to such a magnet.

Figure 2:
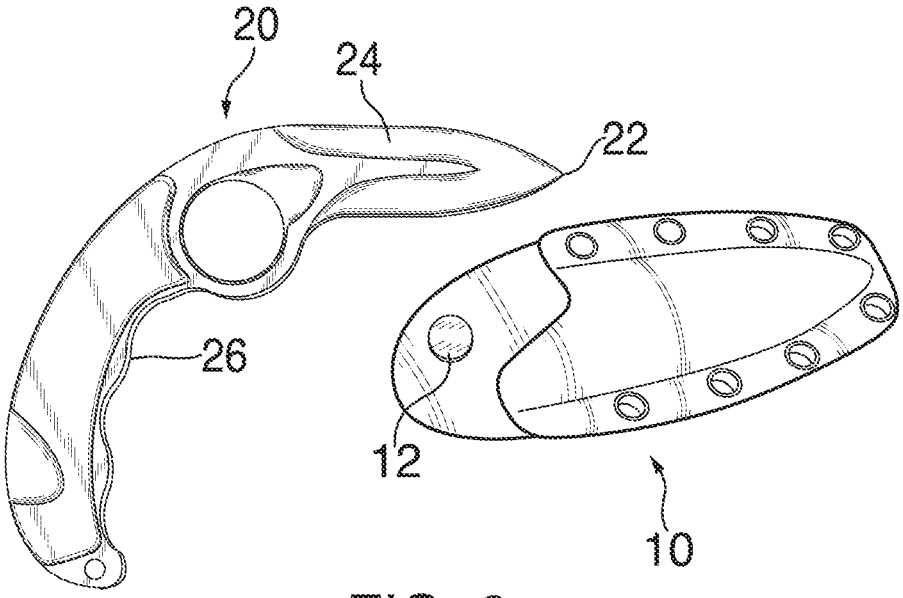
FIG. 2 is a plan view of a combat edged weapon in close proximity to its protective sheath disclosing the preferred location for a permanent magnet at the opening of the sheath.

FIG. 2 shows knife 20 which, for the example presented, is the correct size for sheath 10 thereby providing a carrying device for knife 20. It can be appreciated by considering FIG. 2 how knife 20 fits within sheath 10 by slipping knife point 22 into sheath 10 between the halves of the sheath comprised of back piece 15 and front piece 16 which are manufactured to be affixed together with stitching, rivets or other attachment means suitable for the material used. Leather, plastic or other conventional holster or sheath materials may be used to manufacture sheath 10. The style of the sheath disclosed as a preferred embodiment provides one method to create a pocket or pouch utilizing magnet 12 to create a holster-like carrying device for knife 20.

Sheath 10 otherwise is fashioned with conventional means with the exception of the improvement provided by magnet 12. In reinserting knife 20 into sheath 10, when knife point 22 is in the vicinity of magnet 12, it can be appreciated that knife point 22 will be attracted to, and contact magnet 12, thereby providing the user with a positive contact feel and affirmation that there has been contact between knife point 22 and magnet 12 allowing knife 20 to be inserted inwardly into sheath 10.

When knife 20 is in the vicinity of sheath 10 and point 22 is drawn magnetically to the area of magnet 12, it can be appreciated that the large dimension or flat side area of the knife blade, referred to as blade cheek 24, will continue to stay in contact with magnet 12 as point 22 is slidably inserted in the interior compartment of sheath 10. It is advantageous to embed magnet 12 into the material used to create sheath 10. Such a means of securing magnet 12 into the sheath or holster which uses the invention disclosed prevents the magnet from creating a metal-on-metal sound when a knife or firearm contacts magnet 12. Having a plastic or leather layer between magnet 12 and the knife or firearm being placed into a sheath or holster also reduces possible damage such as scratching a blade or body of a firearm during contact and any sliding motion as the weapon is slid into the pouch portion of the sheath or holster. The material in the area of magnet 12, or magnet 32 in the case of a firearm, can be made of a material with a low coefficient of friction to facilitate the sliding of the weapon over and past the location of the magnet while the weapon is moved into the holster to be secured.

The essence of the disclosed invention is the operation and procedure of contacting the magnet with the weapon and thereafter inserting and seating the edged weapon allowing a user of knife 20, while gripping the knife handle 26, to find the appropriate location on sheath 10. When this occurs, the user is in a position to insert the knife into the sheath without the need to look down or over at the operation. Knife point 22 or cheek 24 of knife 20 is immediately drawn to magnet 12 allowing positive contact.

Figure 3:
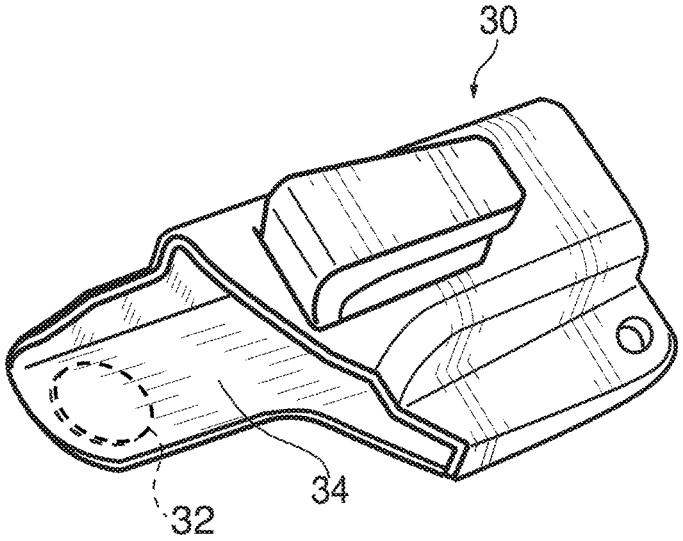
FIG. 3 is a perspective view of a pistol holster with a permanent magnet embedded in the holster extension rising out of the mouth opening of the holster demonstrating a preferred location for a magnet to secure a pistol in a holster.
Figure 4:
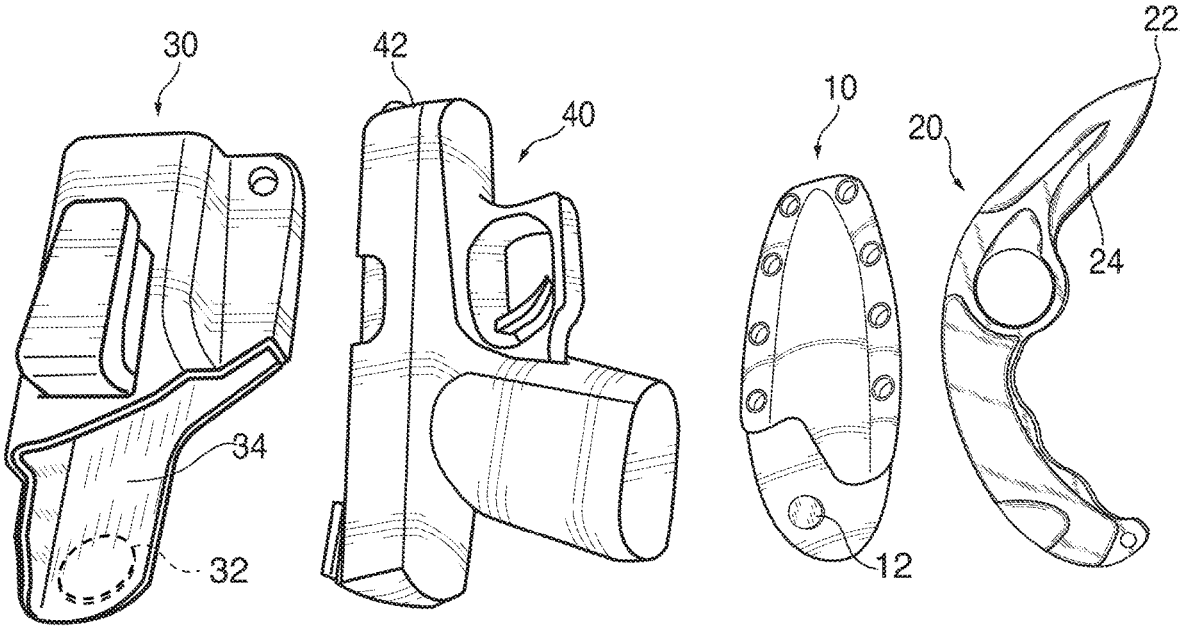
FIG. 4 is a comparative perspective view of the present invention in firearm holster form and in knife sheath form along with typical weapons used in each sheath demonstrating typical construction for the invention.

The same invention translates directly to the use of the combination of a magnet infused holster and a metallic firearm to provide the same effect of ease of holstering. The operation is basically the same with a pistol upon which a magnet has the effect in regard to attracting the pistol to a predefined starting location to insert a pistol into a holster. As can be seen in FIG. 3, holster magnet 32 is embedded in the top of holster 30 such that magnet 32 would attract any ferrous metal in its vicinity such as pistol 40 shown with a mating holster 30 as depicted specifically in FIG. 4. Holster 30 as depicted both in FIG. 3 and FIG. 4 is of the single piece molded plastic type. A belt clip as shown is typical as a means to secure the holster in a user's belt, in the present embodiment, inside a belt. Extension piece 34 of the holster as shown in FIG. 3 and FIG. 4 extend above the pouch area formed to hold the firearm in holster 30 when inserted therein. Piece 34 is the ideal place to embed magnet 32 to create a preferred target area of initial attraction for firearm 40. When placing firearm 40 into holster 30, it can be appreciated that muzzle 42 of firearm 40 will experience the initial attraction force of magnet 32 when the firearm is staged in the area of extension 34 such as to prepare to slide firearm 40 into holster 30. This is because, as is universally true with most holsters, muzzle 42 is the leading edge of travel of firearm 40 toward holster 30 as the user prepares to holster the weapon.

FIG. 4 provides a view of preferred embodiments for both an edged weapon and a typical firearm when paired with suitable sheaths or holsters for each respective weapon. Knife sheath 10, knife 20, holster 30 and firearm 40 together demonstrates the similarity in the operation of the invention as applied to both edged weapons or firearms. Regardless of the type of weapon or instrument involved, it can be appreciated in FIG. 4 that any time a device is held or carried in a sheath-like or holster-like container about a person's body, using a magnetic device embedded in the carrying holster or sheath will assist in reinserting the device into the carrying holster or sheath.

The invention also lends itself to an improved method of securing a firearm, knife or other sheathed or holstered weapon. After drawing a firearm or knife from its holster or sheath in the conventional fashion, the weapon used can be reinserted into its carrying device without bringing the eyes of the user toward to the holster or sheath device. The method of reinsertion of the weapon into its carrying device would include the steps of bringing firearm 40 or knife 20 towards the body of the user and to the location on the user in which holster 30 or sheath 10 within which embedded magnet 32 or 12 respectively is positioned. Once the firearm or knife is in the immediate vicinity of magnet 32 or magnet 12, the user will feel the attraction and contact of firearm 40 or knife 20 with the magnet located in the threshold area of a holster or sheath.

The advantage of this method of securing a weapon into its carrying device is that the user need not look at the holster or sheath to find the entry point of the carrying device. Rather, the user's eyes can remain elsewhere as the magnet will capture the weapon as it travels to the vicinity of the holster or sheath by the action of the user, soon to be captured by the pull of the magnet and leading the weapon to the point on the holster or sheath which allows the weapon to be slid further and seated into the carrying device without the user needing to be distracted by the user focusing on the proper entry of the weapon. After contact with the area in which magnet 32 or 12 is embedded, the user then slides the firearm or the knife respectively into the sheath while the firearm or knife is being held in close proximity by the magnet that is embedded in the holster or sheath. This new method frees the user from any distraction of re-holstering a firearm or re-sheathing a knife. The process of returning the weapon to a holder becomes more of a reflex with a magnetic holster allowing the new procedure to function in a fashion not possible with prior techniques.

What is claimed:

1. A method of holstering a weapon, the method comprising:

moving a body of a weapon toward a holster having an interior cavity configured to receive the body of the weapon by passing at least a portion of the body of the weapon through an entry opening located at an end of the interior cavity;

magnetically attracting a metallic portion of the body into contact with a magnetic portion of the holster, the magnetic portion being located at least partially outside of the interior cavity and proximate the entry opening; and inserting at least a portion of the body of the weapon through the opening and into the interior cavity, wherein magnetically attracting the metallic portion of the body into contact with the magnetic portion of the holster aligns the body of the weapon with the entry opening and provides tactile feedback that facilitates proper insertion of the body into the interior cavity.

2. The method of claim 1, wherein the body of the weapon includes a blade having an edge and a cheek.

3. The method of claim 2, wherein the magnetic portion includes a tip of the blade.

4. The method of claim 2, wherein inserting the body of the weapon through the opening includes sliding the cheek of the blade along the magnetic portion of the holster.

5. The method of claim 1, wherein the weapon is a pistol, and wherein the metallic portion of the body is located on a muzzle of the pistol.

6. The method of claim 1, wherein the weapon is a knife, and wherein the metallic portion of the body is located on a blade of the knife.

7. The method of claim 1, wherein inserting the body of the weapon through the opening includes sliding the body of the weapon along the magnetic portion of the holster.

8. The method of claim 7, wherein the magnetic portion includes a magnet covered by a low-friction material.

9. The method of claim 8, wherein the low-friction material is configured to facilitate sliding the body of the weapon along the magnet.

10. The method of claim 8, wherein the low-friction material is a leather material.

11. The method of claim 8, wherein the low-friction material is a plastic material.

* * * * *